US008011946B2

(12) United States Patent
Chen et al.

(10) Patent No.: US 8,011,946 B2
(45) Date of Patent: Sep. 6, 2011

(54) ELECTRICAL CONNECTOR ASSEMBLY, PLUG, AND SOCKET

(75) Inventors: Song-Ya Chen, Shenzhen (CN); Dong-Wei Zhao, Shenzhen (CN)

(73) Assignees: Fu Tai Hua Industry (Shenzhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/846,755

(22) Filed: Jul. 29, 2010

(65) Prior Publication Data

US 2011/0159720 A1 Jun. 30, 2011

(30) Foreign Application Priority Data

Dec. 30, 2009 (CN) ..... 2009 1 0312748

(51) Int. Cl.
*H01R 4/50* (2006.01)
*H01R 13/625* (2006.01)

(52) U.S. Cl. ..... 439/345; 439/310

(58) Field of Classification Search ..... 439/345, 439/346, 310, 333, 10, 298, 308
See application file for complete search history.

(56) References Cited

U.S. PATENT DOCUMENTS 3,393,395 A * 7/1968 Hubbell ..... 439/333
4,241,969 A * 12/1980 D'Amato et al. ..... 439/318
5,046,961 A * 9/1991 Hoffman ..... 439/141

* cited by examiner

*Primary Examiner* — Hae Moon Hyeon
(74) *Attorney, Agent, or Firm* — Altis Law Group, Inc.

(57) ABSTRACT

An electrical connector includes a socket and a plug. The socket includes a sidewall and defines at least one latching hole. One end of each of the at least one latching hole is defined in the sidewall. The plug includes a main body, at least one latching mechanism, and a switch. The main body includes a first surface and a second surface. The main body defines at least one receiving space, a first groove, and a second groove. The at least one latching mechanism is partially received in the receiving space. The switch is positioned in the second groove and partially external to the first groove. The at least one latching mechanism can slide to engage the switch by an external force, and the switch can cause the at least one latching mechanism to disengage from the switch by an external force.

13 Claims, 5 Drawing Sheets

ELECTRICAL CONNECTOR ASSEMBLY, PLUG, AND SOCKET

BACKGROUND

1. Technical Field

The present disclosure relates to connectors and, particularly, to an electrical connector assembly, a plug and a socket of the electrical connector.

2. Description of Related Art

For connecting some kinds of electrical connectors, for example Video Graphics Array (VGA) connectors, screwing together threaded parts of the connectors which are relatively long is usually troublesome and time consuming.

BRIEF DESCRIPTION OF THE DRAWINGS

The components of the drawings are not necessarily drawn to scale, the emphasis instead being placed upon clearly illustrating the principles of an electrical connector assembly, a plug, and a socket. Moreover, in the drawings, like reference numerals designate corresponding parts throughout several views.

DETAILED DESCRIPTION

Figure 1:
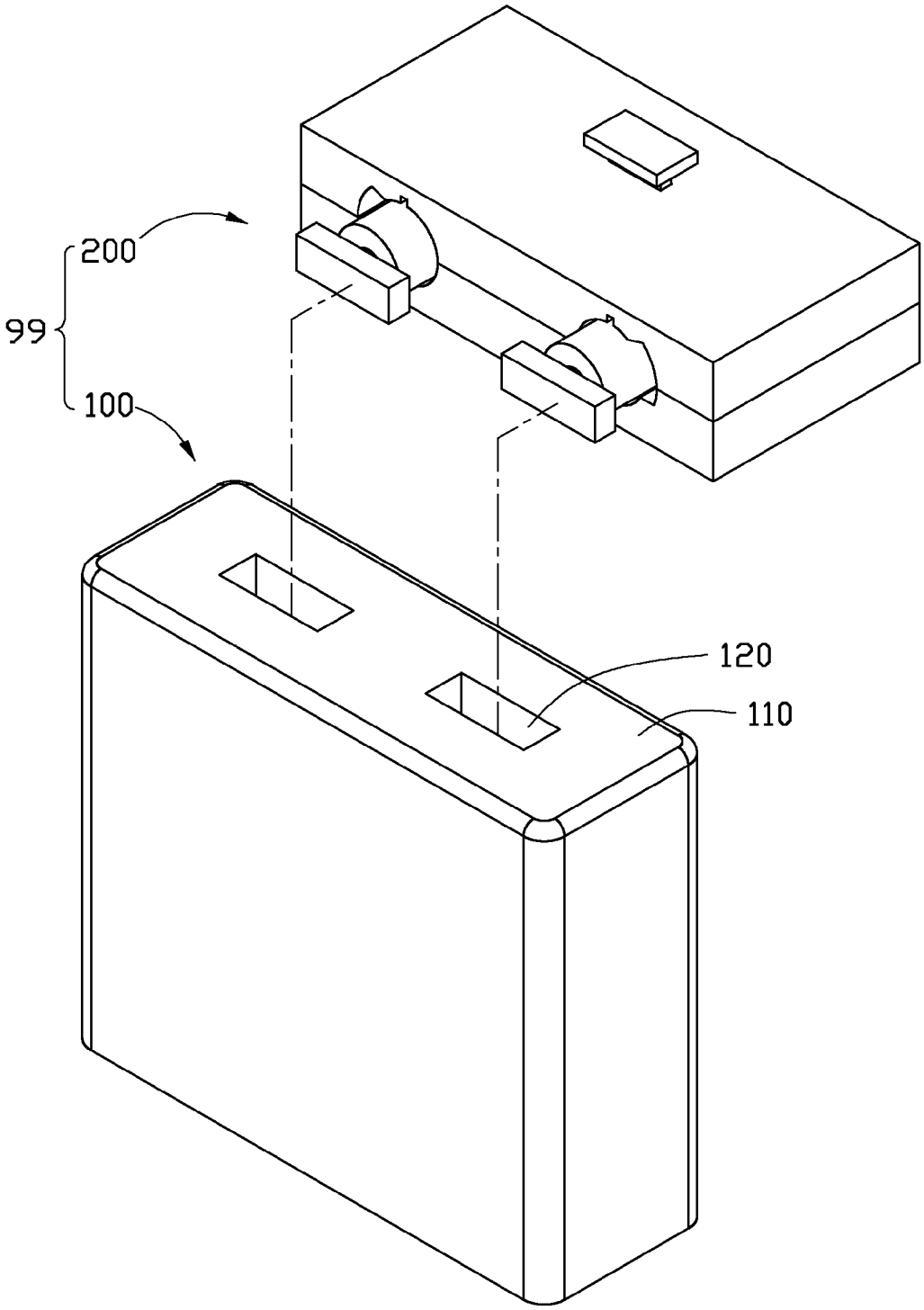
FIG. 1 is an isometric view of an electrical connector assembly in accordance with an exemplary embodiment, showing a plug and a socket of the electrical connector.

Referring to FIG. 1, an electrical connector assembly 99 includes a socket 100 and a plug 200. The electrical connector assembly 99 may be a VGA connector.

Figure 5:
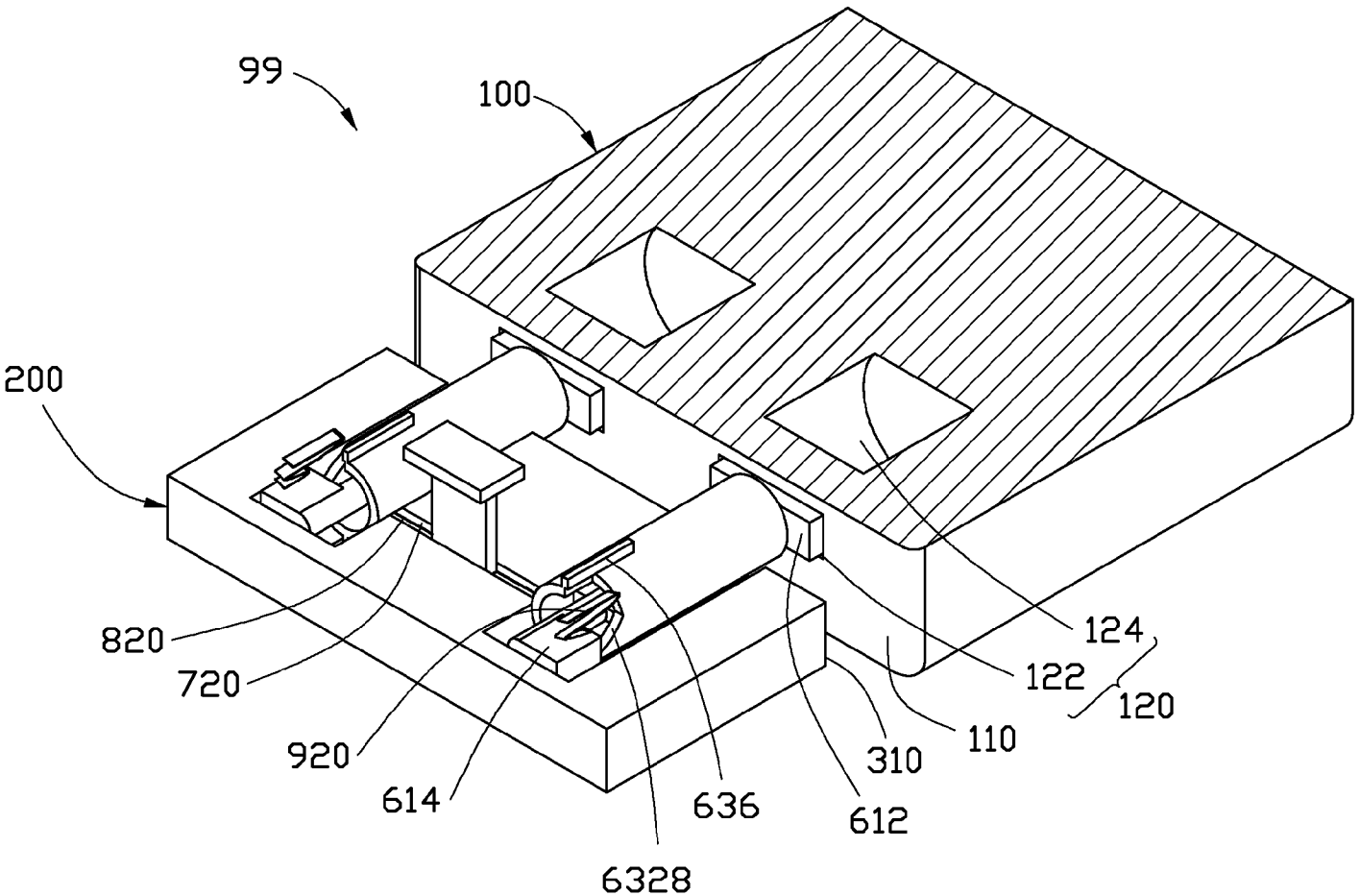
FIG. 5 is a partial, cut-away view of the electrical connector assembly of FIG. 1, showing the plug connected to the socket.

The socket 100 is cuboid and includes a sidewall 110. The socket 100 defines a pair of latching holes 120. Referring to FIG. 5, each latching hole 120 includes a first hole portion 122 and a second hole portion 124 communicating with the first hole portion 122. The first hole portion 122 is defined in the sidewall 110 and is substantially square. The second hole portion 124 is defined within the socket 100 and is substantially cylindrical. A width of the first hole portion 122 is less than the diameter of the second hole portion 124.

Figure 2:
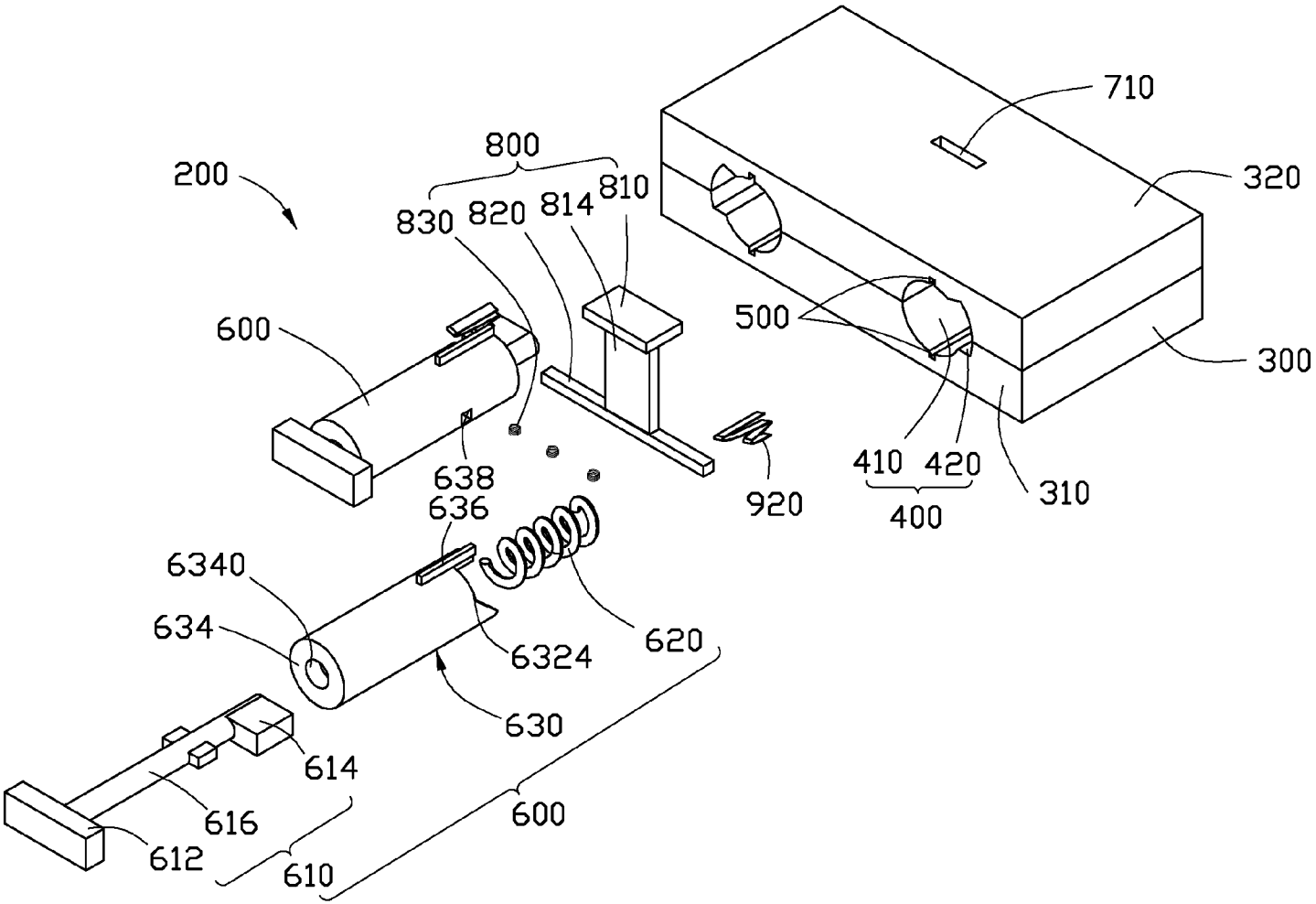
FIG. 2 is an exploded, perspective view of the plug of the electrical connector assembly of FIG. 1.
Figure 3:
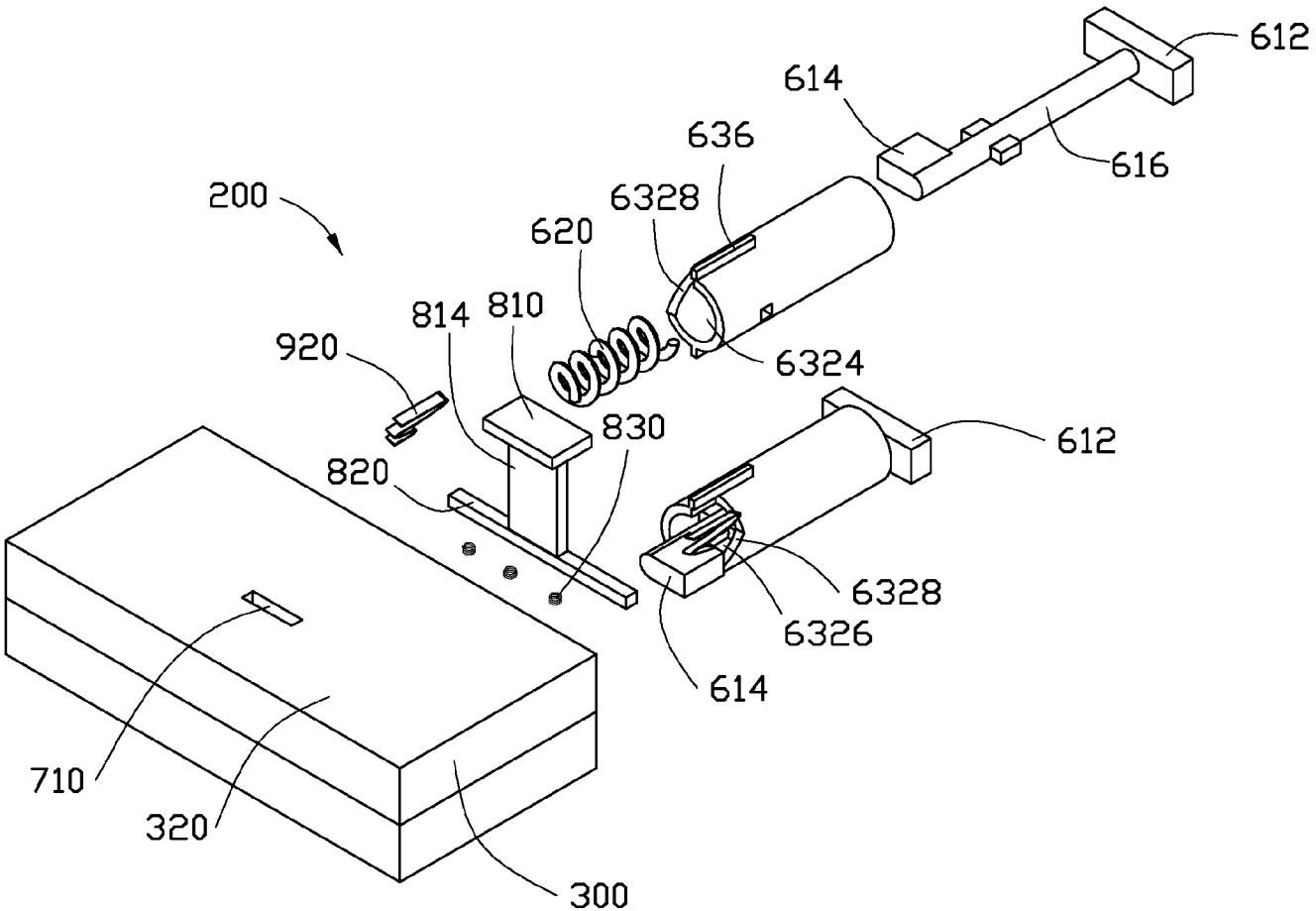
FIG. 3 is another exploded, perspective view of the plug of the electrical connector assembly of FIG. 1, viewed from another viewpoint.
Figure 4:
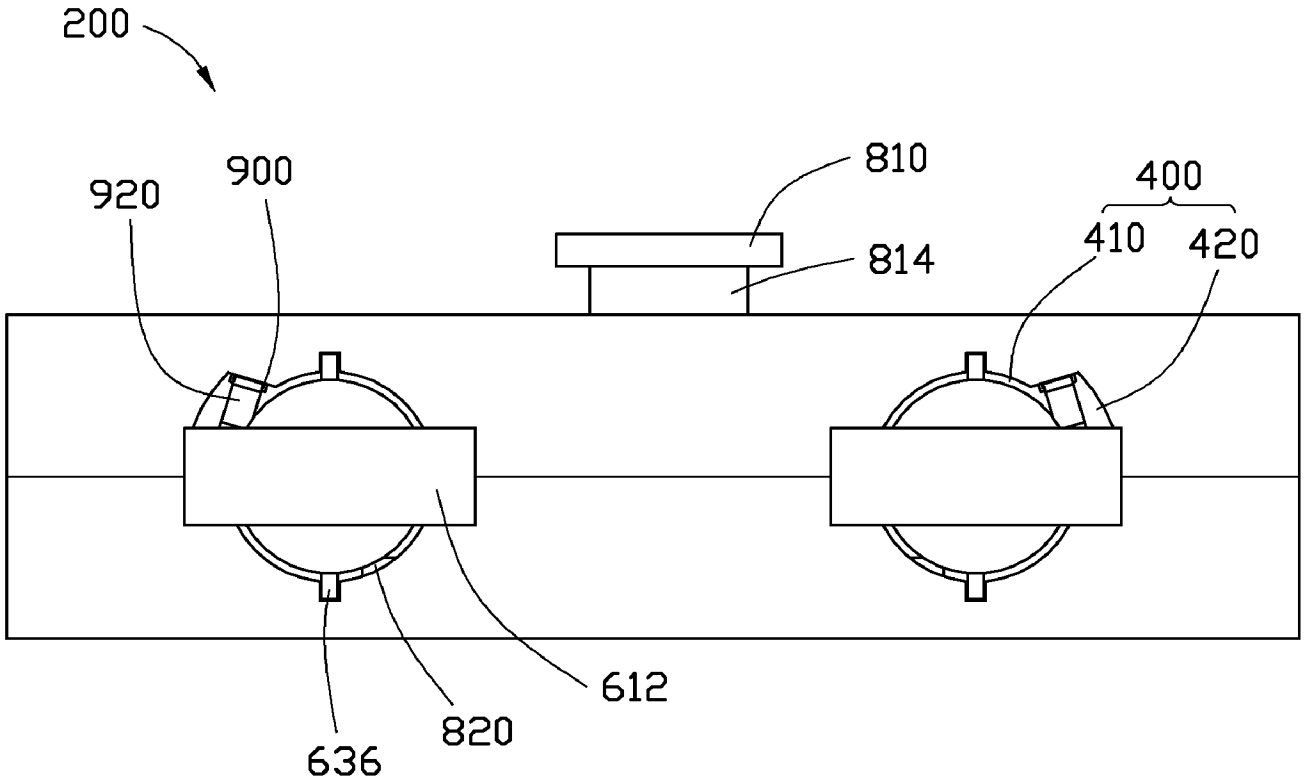
FIG. 4 is a side view of the plug of the electrical connector assembly of FIG. 1.

Referring also to FIGS. 2-4, the plug 200 includes a cuboid main body 300. The main body 300 includes a first surface 310 and a second surface 320 substantially perpendicular to the first surface 310. The main body 300 defines a pair of receiving spaces 400. One end of each receiving space 400 is defined in the first surface 310, and each receiving space 400 extends along a direction perpendicular to the first surface 310. Each receiving space 400 includes a first receiving portion 410 and a second receiving portion 420 communicating with the first receiving portion 410. Each first receiving portion 410 is substantially semi-cylindrical, and each second receiving portion 420 is substantially sector-shaped. The first receiving portions 410 are arranged between the second receiving portions 420. Each first receiving portion 410 defines a pair of opposite slots 500 each extending along the direction perpendicular to the first surface 310. A fixing element 900 is mounted on the sidewall of each second receiving portion 420 to fix one end of an elastic member 920. The main body 300 further defines a first groove 710 and a second groove 720 substantially parallel to the first groove 710. The first groove 710 is defined in the second surface 320, and the second groove 720 communicates with the receiving spaces 400. The first groove 710 is narrower than the second groove 720.

The plug 200 further includes a pair of latching mechanisms 600 and a switch 800. Each latching mechanism 600 includes a latching member 610, an elastic member 620, and a sleeve 630.

Each latching member 610 includes a latching block 612, a projection 614, and a rod 616. The latching block 612 is secured to one end of the rod 616. The width of the latching block 612 is substantially equal to that of the first hole portion 122. The projection 614 is substantially perpendicular to the rod 616 and adjacent to another end of the rod 616. Another end of the elastic member 920 is fixed to the projection 614. The elastic member 620 is arranged over the rod 616 and between the latching block 612 and the projection 614. In this embodiment, the elastic member 620 is a coil spring. The sleeve 630 is arranged over the rod 616 and the elastic member 620 and between the latching block 612 and the projection 614.

The sleeve 630 includes an end 634 resisting the latching block 612. The end 634 defines a through hole 6340 for allowing the rod 616 to extend through. The sleeve 630 further includes an open end 6324. A notch 6326 is formed in the open end 6324. The width of the notch 6326 gradually decreases from the open end 6324 to the end 634, thus a tapered surface 6328 is formed. The tapered surface 6328 resists the projection 614. A pair of opposite rails 636 protrudes from the lateral surface of the sleeve 630 and is adjacent to the open end 6324. The sleeve 630 further defines a positioning hole 638.

The switch 800 includes a pressing plate 810, a connecting plate 814, a positioning plate 820, and elastic members 830. The connecting plate 814 connects the pressing plate 810 to the positioning plate 820. The pressing plate 810 is larger than that of the first groove 710.

In this embodiment, the elastic members 830 and the positioning plate 820 are received in the second groove 720, and the positioning plate 820 presses the elastic members 830. The connecting plate 814 is partially received in the first groove 710, and the pressing plate 810 is external to the first groove 710. Each sleeve 630 is received in one first receiving portion 410, and each rail 636 is received in one slot 500 to guide the movement of each sleeve 630. Each sleeve 630 presses the positioning plate 820 to compress the elastic members 830. The positioning holes 638 are respectively at two opposite sides of the positioning plate 820. A portion of each projection 614 is received in the second receiving portion 420. Each latching block 612 is external to one receiving space 400.

To connect the plug 200 to the socket 100, each latching block 612 is placed in one latching hole 120. The plug 200 is pushed toward the socket 100 until the end 634 of each sleeve 630 is resisted by the sidewall 110. As the plug 200 is further pushed, the sleeves 630 are pushed by the sidewall 110 to slide away from the latching blocks 612. While the sleeves 630 slide away from the latching blocks 612, the projections 614 rotate due to being resisted by the tapered surfaces 6328 of the sleeves 630. The rotation of the projections 614 causes the latching blocks 612 to move into the second hole portions 124 of the socket 100 and rotate in the second hole portions

124 until the latching blocks 612 resist the inner surface of the sidewall 110. At this point, the plug 200 is connected to the socket 100.

In this embodiment, while the sleeves 630 slide away from the latching blocks 612, the elastic members 620 are compressed. As the sleeves 630 slide until each positioning hole 638 moves to one end of the positioning plate 820, the elastic members 830 rebound to cause the ends of the positioning plate 820 to be respectively received in the positioning holes 638, thus the plug 200 is securely connected to the socket 100. The rotation of the projections 614 compresses the elastic members 920.

To detach the plug 200 from the socket 100, the pressing plate 810 is pressed to cause the positioning plate 820 to compress the elastic members 830 and cause the ends of the positioning plate 820 to move out of the positioning holes 638. At this point, the elastic members 620 rebound to cause the sleeves 630 to slide toward the latching blocks 612. While the sleeves 630 slide toward the latching blocks 612, the projections 614 rotate due to being resisted by the tapered surface 6328. The spring force of the elastic members 920 also causes the projection 614 to rotate. The rotation of the projections 614 causes the latching blocks 612 to rotate in the second hole portion 124 until each latching block 612 is aligned with one first hole portion 122. At this point, the further rotation of the projections 614 causes the latching blocks 612 to move out of the first hole portion 122. The plug 200 and the socket 100 can thus be disconnected.

With such configuration, the plug 200 can be easily operated to be securely connected to the socket 100 without having to screw the threaded portions together with a tool or with fingertips.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. An electrical connector assembly, comprising:

a socket comprising a sidewall and defining at least one latching hole, one end of each of the at least one latching hole being defined in the sidewall; and a plug comprising:

a main body comprising a first surface and a second surface perpendicular to the first surface, the main body defining at least one receiving space, a first groove, and a second groove, one end of each of the at least one receiving space being defined in the first surface, and the at least one receiving space extending along a direction perpendicular to the first surface, the first groove being defined in the second surface, the second groove being defined within the main body and communicating with the at least one receiving space, the first groove and the second groove are substantially perpendicular to the at least one receiving space;

at least one latching mechanism partially received in the receiving space; and a switch positioned in the second groove and partially exposed through the first groove;

wherein, the sidewall is able to resist the at least one latching mechanism to cause each of the at least one latching mechanism to move into one of the at least one latching hole and rotate until each of the at least one latching mechanism resists a sidewall of the one of the at least one latching hole, and further cause the at least one latching mechanism to engage the switch, thus connecting the plug to the socket; the switch is further able to cause the at least one latching mechanism to disengage from the switch and rotate to disengage from the at least one latching hole, thus disconnecting the plug from the socket.

2. The electrical connector assembly as described in claim 1, wherein each of the at least one latching mechanism comprises a latching member, a first elastic member, and a sleeve, each of the at least one latching member comprises a latching block, a projection, and a rod connecting the projection to the latching block, each of the at least one latching block is external to one of the at least one receiving space, each of the at least one projection is received in one of the at least one receiving space, each of the at least one first elastic member is arranged over one of the at least one rod and between one of the at least one latching block and one of the at least one projection, each of the at least one sleeve is arranged over one of the at least one first elastic member and between one of the at least one latching block and one of the at least one projection, each of the at least one sleeve comprises a tapered surface resisting one of the at least one projection, when the at least one sleeve is pushed by the sidewall to slide away from the at least one latching block, the at least one projection rotates due to being resisted by the at least one tapered surface, the rotation of each of the at least one projection causes one of the at least one latching block to move into one of the at least one latching hole and rotate in the one of the at least one latching hole until the one of the at least one latching block resists the sidewall of the one of the at least one latching hole, the at least one first elastic member is compressed as the at least one sleeve slides away from the at least one latching block.

3. The electrical connector assembly as described in claim 2, wherein the switch comprises a positioning plate and at least one second elastic member, the positioning plate is pressed by the at least one sleeve to compress the at least one second elastic member, each of the at least one sleeve defines a positioning hole, when each of the at least one latching block resists the sidewall of one of the at least one latching hole, each of the at least one positioning hole is moved to one end of the positioning plate, and the at least one second elastic member rebounds to cause at least one end of the positioning plate to be received in the at least one positioning hole.

4. The electrical connector assembly as described in claim 3, wherein when the positioning plate is pressed by an external force to compress the at least one second elastic member, the at least one end of the positioning plate moves out of the at least one positioning hole, the at least one first elastic member rebounds to cause the at least one sleeve to slide toward the at least one latching block, the at least one projection rotates due to being resisted by the at least one tapered surface, and the rotation of each of the at least one projection causes one of the at least one latching block to move out of one of the at least one latching hole.

5. The electrical connector assembly as described in claim 3, wherein the positioning plate and the at least one second elastic member are received in the second groove, the switch further comprises a pressing member secured to the positioning plate and partially exposed through the first groove.

6. The electrical connector assembly as described in claim 2, each of the at least one receiving space defines at least one slot extending along the direction perpendicular to the first surface, each of the at least one sleeve comprises at least one rail, each of the at least one rail is able to slide in one of the at least one slot to guide the slide of each of the at least one sleeve.

7. The electrical connector assembly as described in claim 2, wherein each of the at least one latching hole comprises a first hole portion and a second hole portion communicating with the fist hole portion, the first hole portion is defined in the sidewall and the second hole portion is defined within the main body, the size of the first hole portion is less than that of the second hole portion, the rotation of each of the at least one projection causes one of the at least one latching block to move from the first hole portion to the second hole portion and rotate in the second hole portion until the one of the at least one latching block resists the sidewall of the second hole portion.

8. A plug, comprising:

a main body comprising a first surface and a second surface perpendicular to the first surface, the main body defining at least one receiving space, a first groove, and a second groove, one end of each of the at least one receiving space being defined in the first surface, and the at least one receiving space extending along a direction perpendicular to the first surface, the first groove being defined in the second surface, the second groove being defined within the main body and communicating with the at least one receiving space, the first groove and the second groove are substantially perpendicular to the at least one receiving space;

at least one latching mechanism partially received in the receiving space; and a switch positioned in the second groove and partially exposed through the first groove;

wherein, the at least one latching mechanism is able to slide to engage the switch by an external force, and the switch is further able to cause the at least one latching mechanism to disengage from the switch by an external force.

9. The plug as described in claim 8, wherein each of the at least one latching mechanism comprises a latching member, a first elastic member, and a sleeve, each of the at least one latching member comprises a latching block, a projection, and a rod connecting the projection to the latching block, each of the at least one latching block is external to one of the at least one receiving space, each of the at least one projection is received in one of the at least one receiving space, each of the at least one first elastic member is arranged over one of the at least one rod and between one of the at least one latching block and one of the at least one projection, each of the at least one sleeve is arranged over one of the at least one first elastic member and between one of the at least one latching block and one of the at least one projection, each of the at least one sleeve comprises an tapered surface resisting one of the at least one projection, when the at least one sleeve is pushed by an external force to slide away from the at least one latching block, the at least one projection rotates from a first position to a second position due to being resisted by the at least one tapered surface, the rotation of each of the at least one projection causes one of the at least one latching block to move from a released position to a lock position, the at least one first elastic member is compressed as the at least one sleeve slides away from the at least one latching block.

10. The plug as described in claim 9, wherein the switch comprises a positioning plate and at least one second elastic member, the positioning plate is pressed by the at least one sleeve to compress the at least one second elastic member, each of the at least one sleeve defines a positioning hole, while the at least one sleeve slides away from the at least one latching block, each of the at least one positioning hole is moved to one end of the positioning plate, and the at least one second elastic member rebounds to cause at least one end of the positioning plate to be received in one of the at least one positioning hole.

11. The plug as described in claim 10, wherein when the positioning plate is pressed by an external force to compress the at least one second elastic member, the at least one end of the positioning plate moves out of the at least one positioning hole, the at least one first elastic member rebounds to cause the at least one sleeve to slide toward the at least one latching block, the at least one projection rotates from the second position to the first position due to being resisted by the at least one tapered surface, and the rotation of each of the at least one projection causes one of the at least one latching block to move from the lock position to the released position.

12. The plug as described in claim 10, wherein the positioning plate and the at least one second elastic member are received in the second groove, the switch further comprises a pressing member secured to the positioning plate and partially exposed through the first groove.

13. The plug as described in claim 9, wherein each of the at least one receiving space defines at least one slot extending along the direction perpendicular to the first surface, each of the at least one sleeve comprises at least one rail, each of the at least one rail is able to slide in one of the at least one slot to guide the slide of each of the at least one sleeve.

* * * * *